US012264550B1

(12) United States Patent
Mahendran et al.

(10) Patent No.: US 12,264,550 B1
(45) Date of Patent: Apr. 1, 2025

(54) DOWNHOLE TOOL FOR SEALING IN OPENHOLE WASHOUTS

(71) Applicant: Halliburton Energy Services, Inc., Houston, TX (US)

(72) Inventors: Mathusan Mahendran, Singapore (SG); Cem Sonat, Singapore (SG); Nithin Kumar Gupta Dachepally, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/478,693

(22) Filed: Sep. 29, 2023

(51) Int. Cl.
*E21B 33/13* (2006.01)
*E21B 33/12* (2006.01)
*E21B 33/128* (2006.01)

(52) U.S. Cl.
CPC ..... *E21B 33/13* (2013.01); *E21B 33/1208* (2013.01); *E21B 33/1285* (2013.01)

(58) Field of Classification Search
CPC .... E21B 33/12; E21B 33/1208; E21B 33/128; E21B 33/13; E21B 33/1285
See application file for complete search history.

(56) References Cited

U.S. PATENT DOCUMENTS 5,358,054 A * 10/1994 Bert ..... E21B 43/086 166/272.5
5,941,313 A 8/1999 Arizmendi
2016/0145965 A1 5/2016 Zhao et al.
2021/0222509 A1 7/2021 Fripp et al.
2022/0186104 A1 6/2022 Fripp et al.
2022/0341280 A1 10/2022 Holderman et al.
2022/0381106 A1 12/2022 Greci et al.
2022/0389787 A1* 12/2022 Oon ..... E21B 33/1212
2023/0069138 A1 3/2023 Least et al.
2023/0109351 A1 4/2023 Least et al.

FOREIGN PATENT DOCUMENTS

WO 2022106848 5/2022
WO 2022106849 5/2022

OTHER PUBLICATIONS

International Search Report and Written Opinion for International Patent Application No. PCT/US2023/077374 dated Jun. 18, 2024. PDF file. 8 pages.

* cited by examiner

*Primary Examiner* — Yong-Suk (Philip) Ro
(74) *Attorney, Agent, or Firm* — Scott Richardson

(57) ABSTRACT

A variety of methods/systems/apparatus/compositions are disclosed, including, in one embodiment, a downhole tool (for use in a borehole) having a mandrel, a sealing element including metal particles disposed about the mandrel, and a piston to move a containment component of the downhole tool in an axial direction to move the metal particles in the axial direction, thereby displacing the metal particles in a radial direction toward a borehole wall to expand the sealing element in the radial direction to form a seal between the downhole tool and the borehole wall.

20 Claims, 5 Drawing Sheets

DOWNHOLE TOOL FOR SEALING IN OPENHOLE WASHOUTS

BACKGROUND

Boreholes may be drilled into subterranean formations to recover valuable hydrocarbons, among other functions. Operations may be performed before, during, and after the borehole has been drilled to produce and continue the flow of the hydrocarbon fluids to the surface. A borehole may be labeled as a wellbore.

A typical operation of downhole applications may be to apply a seal within a borehole. A seal may isolate and contain produced hydrocarbons and pressures within the borehole. There may be a variety of different tools and equipment used to create seals between the outside of a production tubing string and the inside of a casing string, liner, or the wall of a wellbore. Substantial pressure differentials across a seal may induce failure of the seal and may result in substantial loss of time, money, and equipment. Additionally, expanding a wellbore seal may induce substantial deformation and internal stress on a sealing element, which may increase the chance of failure (e.g., due to breaking or tearing). The design and manufacture of wellbore seals may be limited in structure and material choice in order to reduce the chance of failure. It may be suitable to explore alternative manufacturing techniques to produce improved sealing elements.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
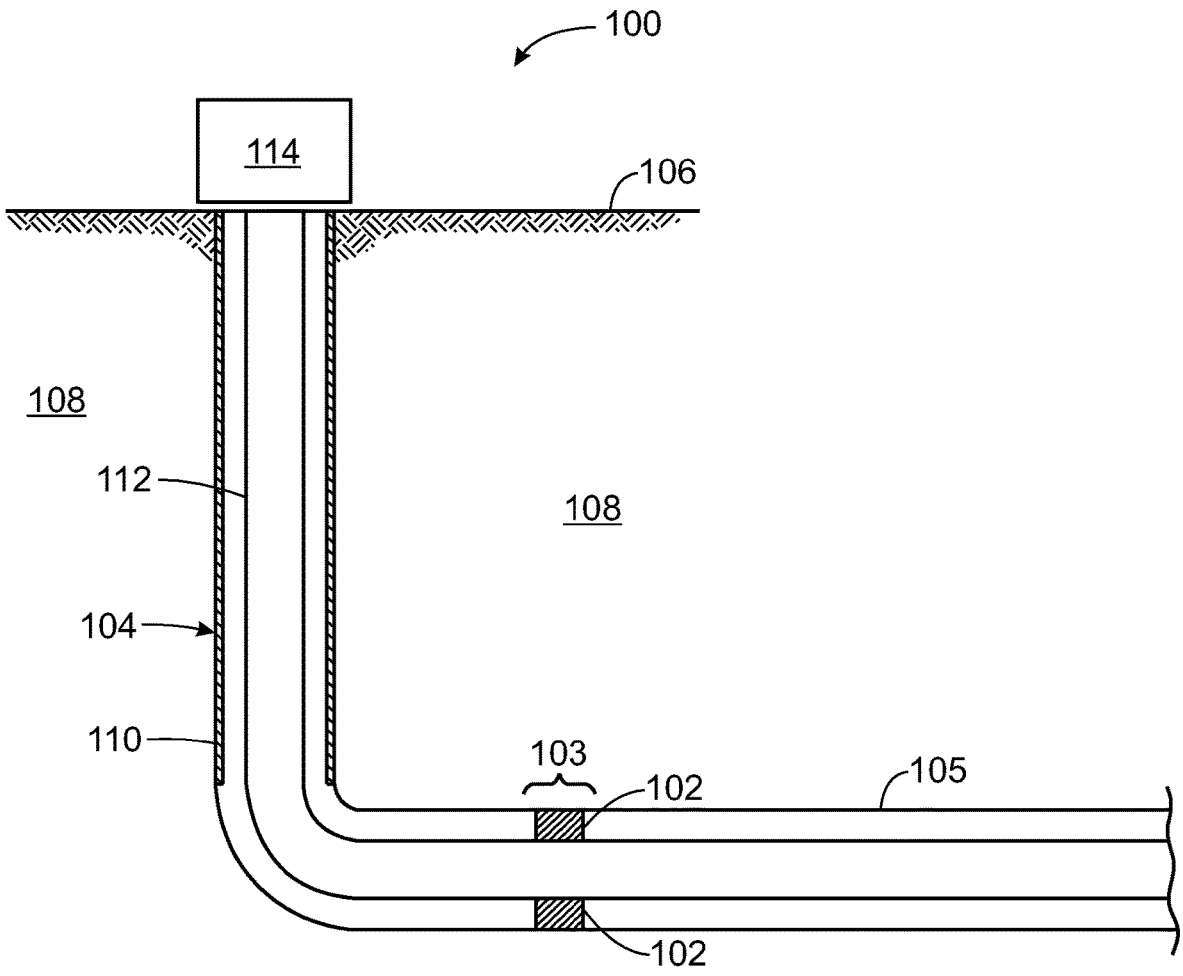
FIG. 1 is a diagram of a well site that includes a packer in an openhole washout portion of a wellbore.

Disclosed herein is a downhole tool with a sealing assembly (sealing element) that include metal elements (e.g., metal particles, metal wire, etc.) disposed about a tool mandrel. In implementations, the sealing assembly can facilitate sealing with a slim outer diameter (OD) downhole tool that is a sealing device in large hole washouts in an openhole interval of a borehole (wellbore). The technique utilizes a piston in the downhole tool to axially compact the metal elements until the metal elements mechanically conform (rearrange) to larger open holes. Thus, the form of the sealing assembly (including the metal elements) can start longer that becomes shorter as the metal elements are collectively mechanically rearranged radially to create a seal between the downhole tool and the borehole openhole wall. In implementations, the metal elements may react with borehole fluid (wellbore fluid) during and after the mechanical rearrangement to chemically expand individual metal elements to fill voids between the metal elements to advance creating the seal.

Other techniques, such as the use of slip-on elements, stacked wedges, expanding C-rings, or inflatable packers are limited in the expansion ratio. The expansion ratio may be defined as a ratio of the increase in cross-sectional area (annular area) of the sealing element in the radial direction divided by the initial cross-sectional area (annular area) of the sealing element in the radial direction. Thus, the expansion ratio is the ratio of the increase in cross sectional area to the initial cross-sectional area of the element. Embodiments of the present techniques can increase the expansion ratio by increasing axial length of the starting sealing element (along the downhole tool) and correspondingly increasing stroke of the axially compacting piston. The expansion ratio with embodiments of the present techniques can be, for example, in the range of 1% to 1000%.

By straightforward increasing the length of the starting element and increasing stroke of the axially compacting piston for the openhole inside diameter (ID) in which the downhole tool is set, the present techniques may theoretically work for any magnitude of hole washouts, however severe. This may advance overcoming limits in the radial direction to beneficially maintain the running OD of the downhole tool slim enough to enter the nominal openhole. Additionally, in implementations, a continually biased compacting mechanism can decrease time to form the seal with the borehole wall. The compacting mechanism may serve to mechanically compact the metal elements (e.g., in unreacted state), into the washed out openhole, relatively fast approaching instantaneous in implementations, and reduce chemical expansion of the metal elements implemented to form the final seal and hence reduce the time to form the seal. Furthermore, for the metal elements as metal particles (e.g., pellets), the force to perform the compaction may be relatively low, reducing need to pump tubing to high hydraulic pressures to actuate the tool, which is common in hydraulic set packers or inflatable packers.

A containment component of a downhole tool (e.g., packer) for containing or holding the metal elements (e.g., particles) may be an upper containment component (towards uphole end) and another containment component of the same packer as a lower containment component (towards downhole end) for containing or holding the metal elements. The direction of movement of the axially compacting piston can be downward (toward downhole) moving the upward containment component in the downward direction, and in which the lower containment component is generally at rest during the axial compaction (shortening axial disposition giving rearrangement into the radial direction) of the metal elements. On the other hand, the direction of movement of the axially compacting piston can be upward (toward uphole) moving the lower containment component in the upward direction, and in which the upper containment component is generally at rest during the axial compaction of the metal elements.

While a focus can be openhole environment, such as with openhole washouts, embodiments of the present techniques can be applicable to a cased hole environment. For instance, there may be a technical need for a packer to pass through a restriction, such as collapsed tubing or collapsed casing, to then seal further downhole in a cased hole larger than that restriction. Embodiments herein facilitate such by allowing (providing for) a slimmer run-in-hole ID for the downhole tool (e.g., packer).

An openhole washout may form in an openhole interval of a wellbore (borehole), for example, due to poor consolidation of the subterranean formation or poor drilling practices of the borehole. The larger openhole washout is an enlarged region (enlarged diameter) of a borehole or wellbore. A washout in an openhole section is larger than the original hole size or size of the drill bit. Washouts may be defined as short, enlarged segments of the wellbore that are larger than the original hole size or drill bit. A washout is an enlarged area of the wellbore caused by removal of formation grains during drilling or circulation. Borehole washout may be the enlargement of the wellbore diameter due to erosion or collapse of the formation, caused by high mud flow rate, low mud density, or weak rock strength. The degree of borehole washout can depend on the wellbore trajectory, the formation lithology, and the drilling conditions. The washout zones can be identified, for example, from caliper logs or image logs, which show the irregular shape and size of the wellbore. The true borehole diameter can be estimated from caliper logs or density logs.

FIG. 1 is a well site 100 that includes a packer 102 set in an openhole washout 103 of a borehole 104 (wellbore). The borehole 104 can be, for example, openhole or have an openhole portion and a cased portion. The borehole 104 is depicted as having a cased vertical portion and a horizontal openhole portion 105.

The packer 102 has a sealing element (sealing assembly) that includes metal elements, such as metal particles, metal wire, etc. In the illustrated implementation, the sealing element has been expanded (increased in cross-sectional area in the radial direction) to form a seal with the borehole 104 wall (formation face). Thus, the packer 102 (or similar downhole tool) can be configured to form the seal in an openhole washout 103 of the borehole 104, as depicted, or to form the seal in a cased portion of the borehole 104 if desired. The packer 102 can be configured to form the seal in an annulus of the borehole 104 between the packer 102 and the borehole 104 wall.

As indicated with respect to subsequent figures, the packer 102 can include a piston to move a containment component of the packer 102 in an axial direction to move the metal elements in the axial direction, thereby displacing the metal elements in a radial direction toward the borehole 104 wall to expand the sealing element in the radial direction to form the seal between the packer 102 and the borehole 104 wall.

In implementations, the packer 102 sealing element may include a retainment sleeve to hold the metal elements (e.g., metal particles) against a mandrel of the packer 102, and wherein the packer 102 piston is configured to apply force to the retainment sleeve to release the metal elements in the radial direction toward the borehole 104 wall. Further, as discussed below, the metal elements (e.g., metal particles) can be configured for reaction with the borehole fluid (e.g., aqueous borehole fluid having water) that increases size of the metal elements to promote forming the seal.

The borehole 104 is formed through the Earth surface 106 into a subterranean formation 108 in the Earth crust. In the illustrated implementation, the borehole 104 has a casing 110 (e.g., metal, plastic, composites, etc.) in a vertical portion of the borehole 104 and is therefore a cased borehole (cased wellbore) in that vertical portion. Cement (not shown) may be disposed between the casing 110 and the formation 108 face. The formation 108 face can be considered a wall of the borehole 104.

In operation (e.g., production), fluid (e.g., hydrocarbon, water, etc.) from the subterranean formation 108 may enter the borehole 104 at the openhole portion 105. Further, in implementations, fluid may enter the borehole 104 through perforations in the casing 110 (and cement) from the subterranean formation 108 at the cased portion. The fluid may be produced (routed) as produced fluid through production tubing 112 to the surface 106. The surface equipment 114 may include a wellhead for receipt of the produced fluid. In other implementations, the borehole 104 can be utilized for injection of fluid from the surface 106 through the borehole 104 into the subterranean formation 108.

The production tubing 112 may be a tubing string utilized in the production of hydrocarbons. The packer 102 may be disposed on or near production tubing 112. Depending on the type of packer 102, the packer 102 may be permanently set or retrievable, mechanically set, hydraulically set, and/or combinations thereof. The packer 102 may be set downhole to seal off a portion of borehole 104. When set, packer 102 may isolate zones of the annulus between casing 110 and the production tubing 112 (e.g., a tubing string) by providing a seal (fluid seal) between the production tubing 112 and the borehole 104 wall (formation 108 face). Again, in examples, the packer 102 may be disposed on the production tubing 112.

The surface equipment 114 can include a hoisting apparatus (e.g., for raising and lowering pipe strings) and a derrick. The surface equipment 114 and equipment deployed in the borehole 104 can include equipment, such as a wireline, slickline, coiled tubing, tubing string, pipe, drill pipe, drill string, and the like, that facilitates mechanical conveyance for deploying downhole tools (e.g., packer 102 and other tools). The deploying of the downhole tool (e.g., packer 102) may include lowering the downhole tool into the borehole 104 from the surface 106 and setting (e.g., via mechanical slips) the downhole tool in the borehole 104. In some implementations for the downhole tool as a packer 102, the equipment (e.g., wireline) may provide electrical connectivity, for example, to operate the packer 102.

As discussed, an openhole washout (e.g., openhole washout 103) is an enlarged region (increased diameter) of a wellbore (e.g., borehole 104). A washout in an openhole section is larger than the original hole size or size of the drill bit. Washout enlargement can be caused by excessive bit jet velocity, soft or unconsolidated formations, in-situ rock stresses, mechanical damage by bottom hole assembly (BHA) components, chemical attack and swelling or weakening of the subterranean formation 108 (e.g., shale) as contacts fresh water. In general, openhole washouts can become more severe (increased in diameter) with time. Appropriate mud types, mud additives and increased mud density during drilling can reduce presence (occurrence) of washouts.

It should be understood by those skilled in the art that present examples are equally well suited for use in wellbores having other directional configurations including vertical wellbore, horizontal wellbores, deviated wellbores, multilateral wells and the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface 106 of the well and the downhole direction being toward the toe of the well. Also, even though FIG. 1 depicts an onshore operation, it should be understood by those skilled in the art that the packer and its sealing elements of the present techniques are equally well suited for use in offshore operations.

Moreover, while the discussion herein may at times focus on application in openhole (e.g., at openhole washouts), the techniques can be applicable to cased hole. For example, there may be instances of passing through narrow production-tubing restrictions and set in a larger cased hole further below. The techniques facilitates that by having a slimmer running OD to expand into a larger cased hole.

Figure 2A:
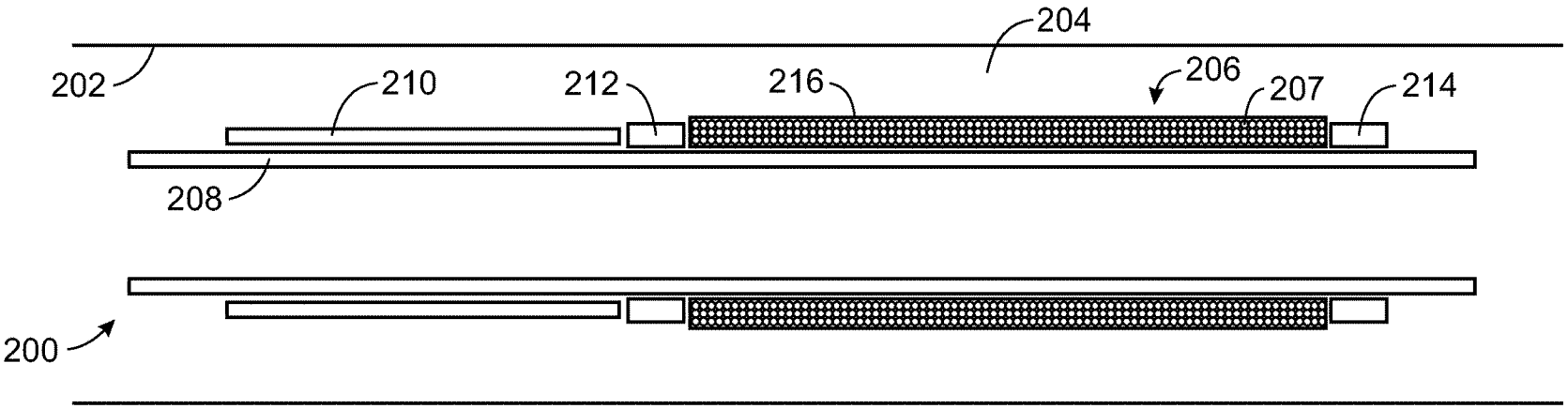
FIGS. 2A and 2B are diagrams collectively of a time sequence a downhole tool (e.g., packer) situated in a borehole.
Figure 2B:
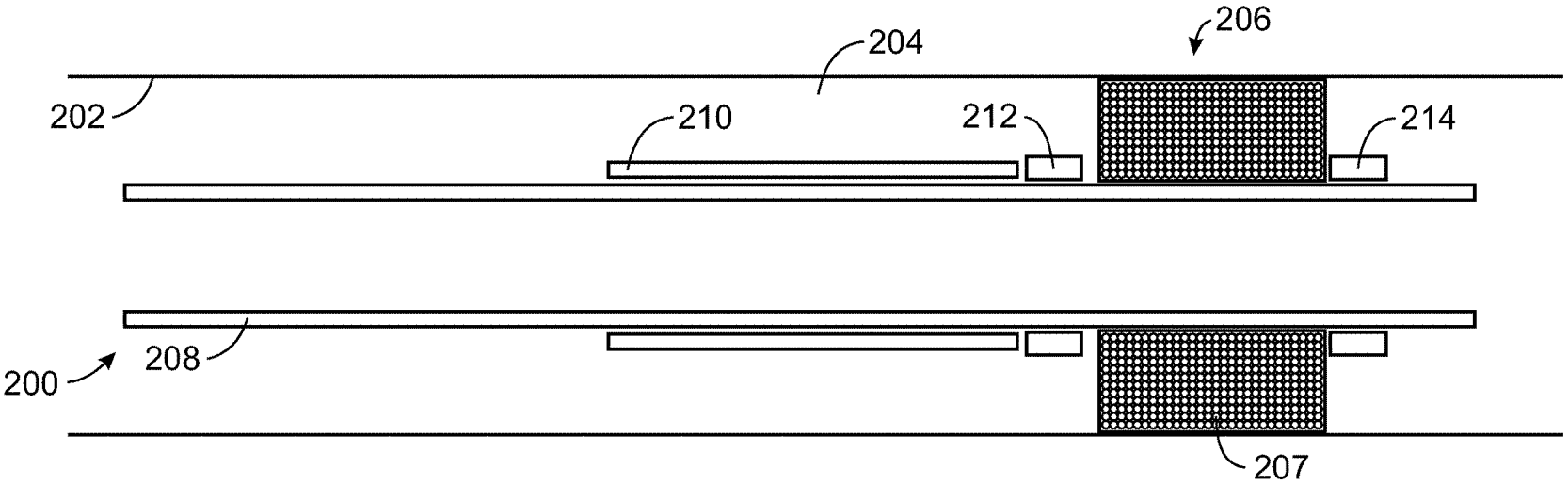

FIGS. 2A and 2B collectively are a time sequence of a downhole tool 200 (e.g., packer) situated in a borehole 202. The borehole 202 may be formed in a subterranean formation, as discussed with respect to FIG. 1. FIG. 2A is earlier in time than FIG. 2B. FIG. 2A is initially with the downhole tool placed in the borehole 202. FIG. 2B is later in time after operation of the downhole tool 200 to form a seal in the borehole 202, and in which the seal is formed.

The depiction of the downhole tool 200 is a simplified representation for clarity. The view can be characterized as a cross-sectional view. In the illustrated embodiment, to the left is the upper or uphole portion of the tool 200 toward uphole (toward the surface). To the right is the lower or downhole portion of the tool 200 toward downhole further in the borehole 202. It can instead be vice versa in other embodiments, where the left side becomes the downhole portion, while right side can be uphole version. Yet, for the sake of discussion of FIGS. 2A and 2B, to the right is downhole and to the left is uphole.

The downhole tool 200 is disposed at an openhole washout of the borehole 202. The downhole tool 200 is utilized to form a seal between the downhole tool 200 and the borehole 202 wall. Thus, the seal is formed in an annulus 204 between the downhole tool 200 and the borehole 202 wall. The packer 200 may be analogous to the packer 102 of FIG. 1 and the packer 300 of FIG. 3.

The downhole tool 200 includes a sealing element 206 having metal particles 207 disposed about a tool mandrel 208 of the downhole tool 200. The number of metal particles 207 may be, for example, in the hundreds or thousands. The particle size (e.g., diameter) of the metal particles 207 may be, for example, in the range of 200 microns to 20 millimeters (mm), or in the range of 1 mm to 20 mm.

The downhole tool 200 includes a piston 210 to move a containment component 212 of the downhole tool 200 in an axial direction to move (push, compact) metal particles 207 of the sealing element 206 in the axial direction, thereby displacing (rearranging) the metal particles 207 in a radial direction. The displacement of the metal particles 207 is in the radial direction toward the borehole 202 wall to expand the sealing element 206 in the radial direction to form a seal between the downhole tool 200 and the borehole 202 wall. The containment component 212 may be, for example, petal plates, rubber cups, inflatable elements, expansion foam, or expansion rubber, etc. The containment component 212 may be positively biased and/or mechanically deployed by action of the piston 210. In implementations, the piston 210 is a hydrostatic piston driven by borehole (wellbore) pressure and thus moved by borehole (wellbore) fluid.

In the illustrated embodiment, the movement of the piston 210 and the containment component 212 (to move the metal particles 207) is in the downward direction (to the right). In the depicted example, the containment component 212 is an upper containment component, and the downhole tool includes a lower containment component 214. The lower containment component 214 may be similar to the upper containment component 212 but in operation the lower containment component 214 restrains (limits, prevents) axial movement of the metal particles 207 past the lower containment component 214 toward downhole. Thus, this restraint by the lower containment component 214 facilitates displacement of the metal particles 207 in the radial direction as the piston 210 and the upper containment component 212 move the metal particles 207 axially downward along the mandrel 208.

As indicated with the time sequence of FIG. 2A to FIG. 2B, the expanding of the sealing element 206 in the radial direction by the displacement (mechanical rearranging) of the metal particles 207 in the radial direction increases the cross-sectional area (e.g., annular cross-sectional area) of the sealing element 206 in the radial direction toward the borehole 202 wall. The expansion ratio (which is the ratio of the increase in the cross-sectional area of the sealing element 206 to the initial cross-sectional area in the radial direction) may be, for example, in the range of 1% to 1000%. In implementations, the expansion ratio or the ratio of the increase in the cross-sectional area of the sealing element 206 to the original cross sectional area in the radial direction is at least 90% (e.g., in the range of 90% to 1000%), at least 120% (e.g., in the range of 120% to 1000%), or at least 200% (e.g., in the range of 200% to 1000%). This expansion ratio or increase in the cross-sectional area is the ratio of the increase of the final cross-sectional area of the sealing element 206 in the radial direction divided by the initial cross-sectional area of the sealing element 206 in the radial direction.

In implementations, the outside portion 216 of the sealing element 206 (a sealing assembly) may include a retainment sleeve (not shown) to initially hold (see FIG. 2A) the metal particles 207 against the mandrel 208. In operation, the moving piston 210 may apply force to the retainment sleeve to release (see FIG. 2B) the metal particles 207 in the radial direction toward the borehole 202 wall. In particular, the force applied via the piston 210 may squeeze, crumple, or crush the retainment sleeve to rupture the retainment sleeve.

In examples, the retainment sleeve is dissolvable (dissolves in response to being exposed to the borehole fluid) and has a protective coating to initially prevent exposure (see FIG. 2A) of the retainment sleeve to the borehole fluid. The protecting coating (not shown) prevents exposure to borehole fluid on surfaces of the retainment sleeve having the coating directly in contact with borehole fluid. With the force applied by the piston 210, the protective coating may be disrupted or broken allowing (facilitating) exposure of the dissolvable retainment sleeve to the borehole fluid (including exposure to an inner diameter surface of the retainment sleeve not initially in contact with the borehole fluid). Therefore, with the protective coating compromised, the retainment sleeve may dissolve, and the metal particles 207 released with or without mechanical rupture of the retainment sleeve.

In embodiments, the material selection of the metal particles 207 may provide for reaction of the metal particles 207 with borehole fluid and in which the reaction increases size of the metal particles 207 to promote forming the seal. The metal particles 207 may be, for example, at least one of calcium, magnesium, aluminum, or other metal. In implementations, the metal particles 207 may chemically react with borehole fluid (having water) to increase particle size of the metal particles 207 after the metal particles 207 are displaced (mechanically rearranged) in the radial direction to form the seal. For example, the increase in particle size may be by swelling metal particles 207 exposed to the borehole fluid (wellbore fluid). For instance, the reaction may be to hydrolyze the metal particle (e.g., magnesium) into a metal hydroxide (e.g., magnesium hydroxide) that swells the metal particle increasing the particle size.

In embodiments, the majority (e.g., at least 60%, or in the range of 60% to 99%) of the seal is formed via the mechanical rearrangement of the metal particles 207 and a minor portion (e.g., less than 40%, or in the range of 1% to 40%) is formed via the chemical reaction. In examples, the forming of the seal may rely majorly on the mechanical rearrangement and less due to chemical reaction.

In examples, the material selection of the metal particles 207 may be such that the metal particles 207 react (e.g., significantly react with the borehole fluid). Yet, the metal particles 207 may simply stop reacting once the byproduct forms in the spaces between the metal particles 207.

The downhole tool 200 as a packer installed in the borehole may be permanently set or retrievable, mechanically set, hydraulically set, and/or combinations thereof. A retrievable packer may be a type of packer that is run and retrieved on a running string or production string, unlike a permanent production packer that is set in the casing or liner before the production string is run. A packer may be device that can be run into a wellbore with a smaller initial outside diameter that then expands externally to seal the wellbore. A packer may be a production packer, test packer, isolation packer, etc. A typical packer assembly incorporates a means of securing the packer against the borehole wall, such as a slip arrangement, and a means (e.g., sealing elements) of creating a reliable hydraulic seal to isolate the annulus. Packers are typically classified by application, setting method and possible retrievability.

Figure 3A:
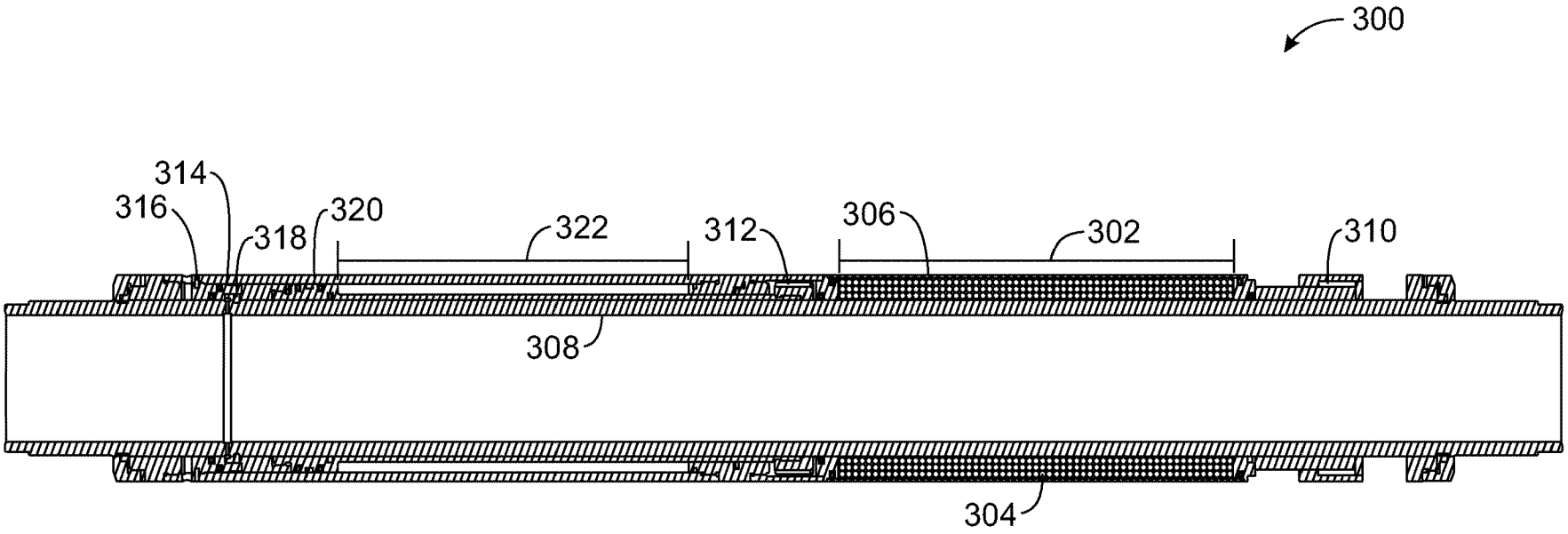
FIGS. 3A, 3B, and 3C are diagrams of a time sequence of a downhole tool (packer) having a sealing element being actuated.
Figure 3B:
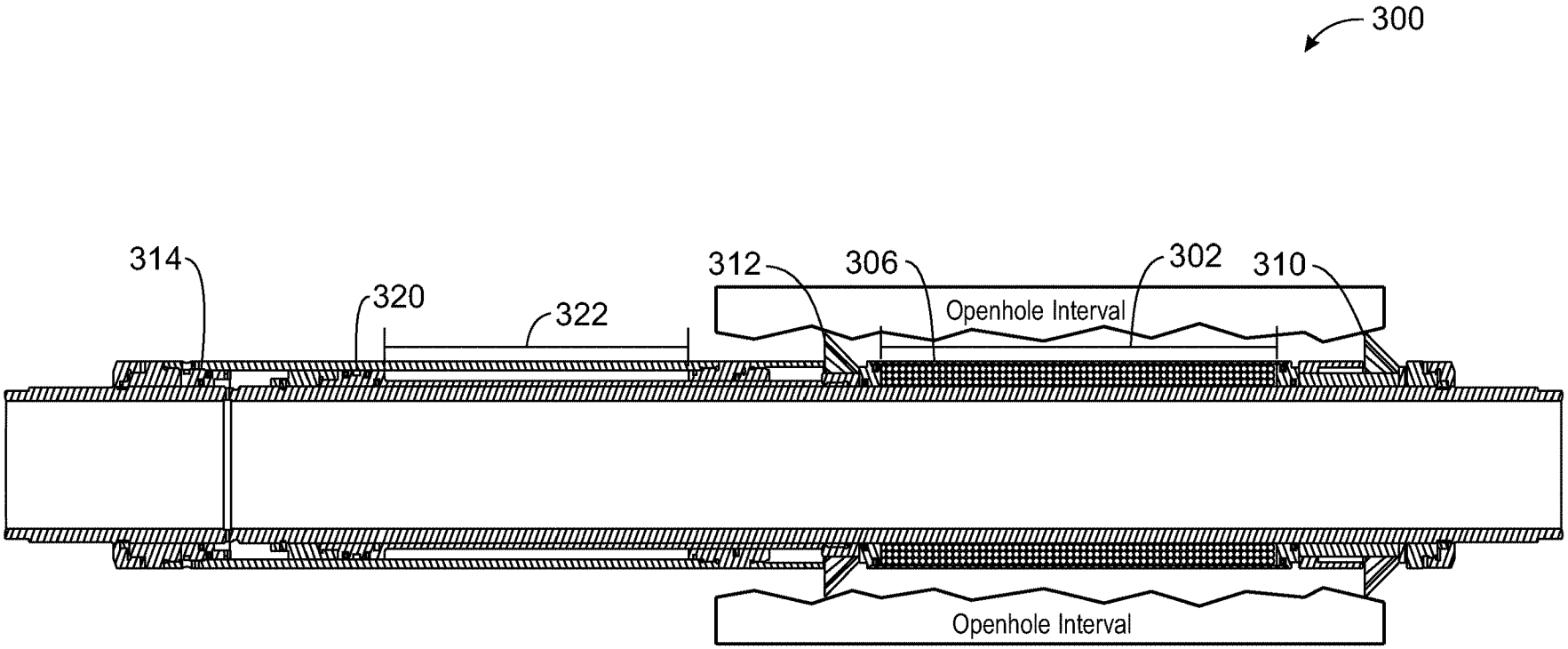
Figure 3C:
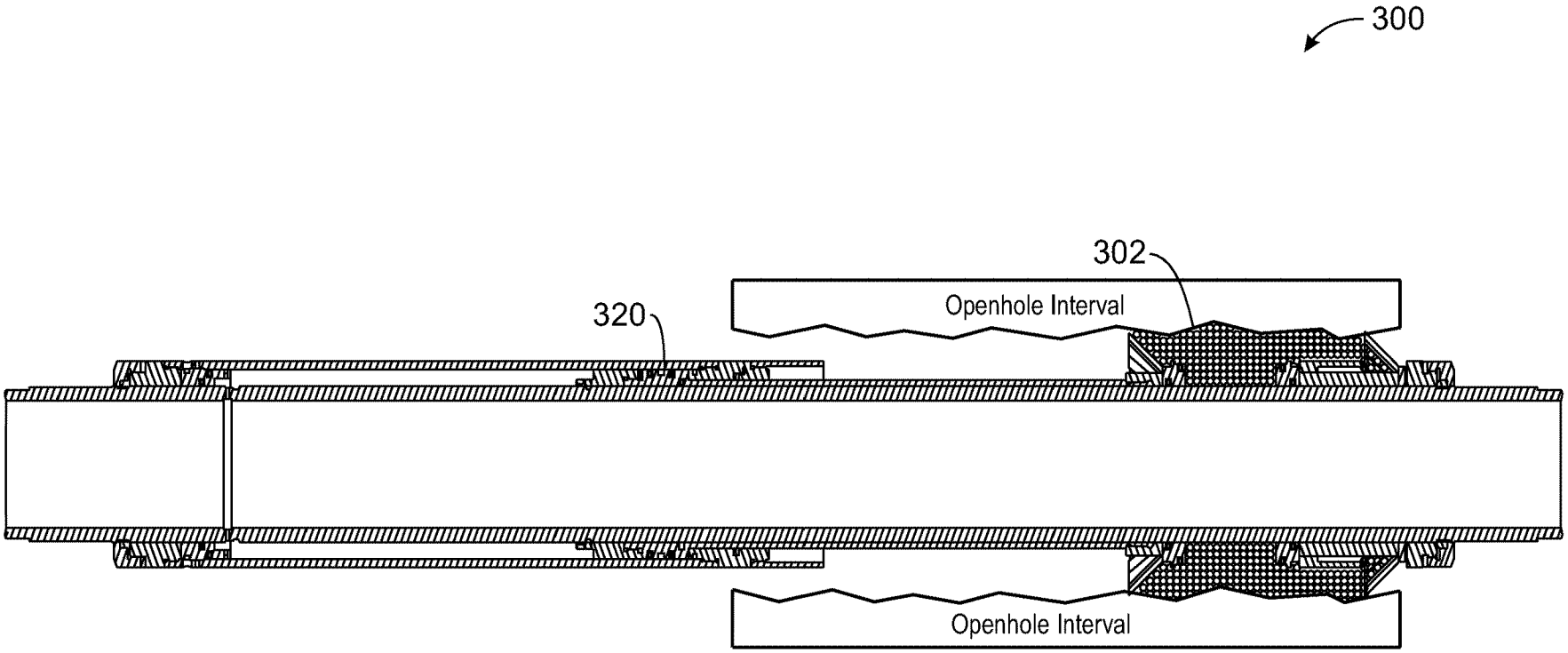

FIGS. 3A-3C collectively are a time sequence of a downhole tool (packer 300) having a sealing element 302 (expandable metal element assembly) being actuated. The packer 300 may be analogous to the packer 102 of FIG. 1 and the packer 200 of FIG. 2. The packer 300 has the sealing element 302 that compacts axially and expands radially. Downhole tools other than a packer can employ the sealing element 302. The metal elements are depicted as metal particles 304, but instead could be, for example, metal wire. The number of metal particles 304 may be, for example, in the hundreds or thousands.

FIG. 3A is the packer 300 as initially being run in hole (RIH) into a wellbore (not shown) before actuation. The sealing element 302 (expandable metal element assembly as a seal) includes the metal particles 304 and a retaining sleeve 306 (retainment sleeve). The retaining sleeve 306 may be a dissolvable retaining sleeve (with coating). The metal particles 304 are held by the retaining sleeve 306 against the mandrel 308 (tool mandrel) of the packer 300. The metal particles 304 (e.g., pellets, spheres, granules, beads, balls, etc.) can be spherical, elliptical, irregular in shape, and/or other shape. The particle size of the metal particles 304 may be, for example, in the range of 200 micron to 20 mm, or in the range of 1 mm to 20 mm. The number of metal particles may be, for example, at least 100 (e.g., in the range of 100 to 100,000). The metal particles 304 are situated under the retaining sleeve 306.

The retaining sleeve 306 may be dissolvable in that sleeve 306 dissolves in response to being exposed to the water-based fluid environment (aqueous wellbore fluid) in the wellbore (borehole). The retaining sleeve 306 can have a protective coating (not dissolvable in the wellbore fluid) on the outside surface of the sleeve 306 to shield the retaining sleeve 306 from exposure to the wellbore fluid (borehole fluid). The retaining sleeve 306 as intact facilitates protecting the metal particles 304 from exposure to the wellbore fluid. The metal particles 304 prior to exposure to the wellbore fluid (and thus prior to any reaction with the wellbore fluid) are in an unreacted state.

On the two axial sides of the sealing element 302 is axial containment of the metal particles 304. The axial containment includes the lower containment component 310 (containment device on the downhole side) and the upper containment component 312 (containment device on the uphole side). In the illustrated embodiment, the undeployed containment components 310, 312 are each petal plates with mesh. Petal plates are generally single ended collets positively biased outwards to conform to a washed-out openhole ID. The petal plates are typically made of stamping sheet metal into shape of a flower. The finger-like structures (petals) being bent to have a positive bias. For implementations, mesh (e.g., strips of mesh) is attached (e.g., welded) to the fingers to account for the space (empty space) between the fingers so that the mesh forms a sort of cup to catch and contain the material (metal particles 304).

The containment components 310, 312 (petal plates), once deployed, may be designed (configured) to contain the particles 304 (including as reacted with the borehole fluid if so reacted) and thus promote (facilitate) the particles 304 to consolidate to form a pack. In FIG. 3A, the containment components 310, 312 (petal plates-with-mesh) are not yet deployed. Containment components other than petal plates-with-mesh may be employed on the packer 300 to axially contain the metal particles 304.

In the illustrated example, components involved in the actuation (deployment) of the containment components 310, 312 include a start-to-set piston 314 (as a shear pinned piston) (with start-to-set screws 316), anti-preset lugs 318, and a hydrostatic piston 320.

FIGS. 3B and 3C are the packer 300 at the target location in the wellbore. In the time sequence depicted collectively by FIGS. 3A-3C, FIG. 3B is later in time than FIG. 3A, and FIG. 3C is later in time than FIG. 3B. FIGS. 3B and 3C depict the start-to-set piston 314 as sheared and the containment components 310, 312 as deployed. FIG. 3C depicts the hydrostatic piston 320 as fully stroked.

In implementations, after the packer 300 is situated (set) at the target location or depth in the wellbore, the containment components 310, 312 may be actuated. The target location may be a washed-out openhole portion of the wellbore. The containment components 310, 312 are deployed (actuated) when desired to compact the sealing element 302 axially to deploy (rearrange) the sealing element 302 outward radially toward the wellbore wall. The containment devices 310, 312 are deployed to retain the metal elements (metal particles 304) being rearranged as compacted in the axial direction and moved in the radially outward direction. The metal particles 304 may be in an unreacted state (during the rearrangement before exposure to the wellbore fluid). In implementations, the metal particles 304 upon and after exposure to the wellbore fluid having water may be in a reacted state in that the metal particles 304 react with the wellbore fluid.

Referring to FIGS. 3A, 3B, and 3C, an actuating mechanism is depicted with the mechanism hydraulically unlocked whereby the start-to-set piston 314 (shear pinned piston 314) has its start-to-set screws 316 sheared at a predetermined wellbore tubing pressure and stroked away to allow the set of anti-preset lugs 318 to pop out from a retaining profile in the mandrel 308. This allows the hydrostatic piston 320 (with the vacuum/air chamber 322 behind the piston 320) to be unlocked and then driven by wellbore hydrostatic pressure to compact or compress the expandable metal element assembly (sealing element 302) axially. The chamber 322 may have air and/or be under a vacuum. The direction of movement of the piston 320 is downward (or toward downhole) in the illustrated embodiment. A benefit of the piston 320 downward direction can be to use the effect of gravity in the compacting phase. In other implementations, the direction of movement of the piston 320 but can instead be upward (or toward uphole).

The use of a hydrostatic piston 320 to do the compacting is significant in implementations. The operator may unlock the start to set piston at a low pressure and proceed to perform other well operations while the hydrostatic piston does the compacting work over a relatively long period of time if needed. In examples, the axial compacting and mechanical rearrangement of the metal particles 304 can be near instantaneous. On the other hand, depending on the expandable metal embodiment, time may be needed for the expandable metal to react, become weak and start to collapse on itself so that the piston can axially stroke and compress into the larger washout inside diameter (ID) to form the seal. Yet, in examples, little or no reaction is needed or employed with or for the mechanical rearrangement of the metal particles 304, and/or the mechanical rearrangement of the metal particles 304 may be relatively quick or even near instantaneous. However, it may be beneficial for the compaction to occur after at least a certain extent of reaction has taken place. Moreover, in implementations, the mechanical rearrangement can occur at any point in time before, during, and/or after the reaction.

The force to compact may also be relatively high depending on the strength of the expandable metal embodiment, hence employing a hydrostatic piston may facilitate the operator to rely on lower actuating pressures. Once unlocked by tubing pressure (e.g., production tubing pressure), the hydrostatic piston can generally stroke and first deploy the upper and lower containment to the openhole ID, represented in FIG. 3B. The piston 320 may then generally proceed to crumple the dissolvable retaining sleeve to weaken the protecting coating and permit reaction by (a) permitting entry of reacting fluid (wellbore fluid) into to the ID side of the retaining sleeve 306, which has no protecting coating, and/or (b) cracking the coating by deformation and exposing the underlying dissolvable substrate of the retaining sleeve 306. As the dissolvable retaining sleeve begins to dissolve, crack, or a combination of both, the metal particles 304 are released into the openhole interval and exposed to the reacting fluids. As the piston continues to stroke, the pellets and remnants of the dissolvable are swept along the openhole interval by the upper containment 312, which, in this embodiment, are petal plates with strongly outward biased fingers, with mesh in between them. In implementations, the metal particles 304 are compacted mostly in unreacted state (but may be partially reacted) until they completely pack off the annular space in the openhole. The spaces between the metal particles 304 may then be filled by chemical expansion of the expandable metal until a seal is formed. FIG. 3C depicts a final state of the assembly and expanded metal embodiment.

Other metal elements (e.g., expandable metal elements) may be utilized in place of the metal particles, such as layers of wire, solid element tubes with milled slots/holes to introduce weak points, or a set of thin tubes nested upon one another, and so on. Additionally, the unreacted material can be between 0-100% of the volume in the final formed annular seal, facilitating the option of the expandable metal element (e.g., particles, wire, etc.) to chemically react (including fully reacting or nearly fully reacting in implementations) before the metal element is fully mechanically compacted. As discussed, the direction of compaction may be towards the down end of the well, so to beneficially utilize (rely on) gravity of the falling expandable metal element to aid in the compacting action. However, the direction of compaction may also be in the opposite direction (toward uphole), towards the up end of the well, similar to hydraulic set rubber element packers. The compacting stroke may be anywhere, for example, between 1% to 1000% (10X) of the final sealing element length once formed in the annular space, depending on the available starting volume of alloy, accounting for possible material losses as it is swept along the wellbore and the final annular volume to be filled.

The starting expandable metal element length along the plug may be, for example, in the range of 150% to 1000% (10X) [or 200% to 1000%, or 300% to 1000%] of the final sealing element length once formed in the annular space. In certain implementations, the metal may typically be an alloy.

As discussed, the containment may be positively biased petal plates with mesh but other forms such as rubber cups, inflatable elements, high expansion foams, rubber, etc., which may be positively biased or mechanically deployed by action of a piston, may be utilized. The well may be vertical, or almost vertical (at a deviation angle less than 90 degrees), in which case, a compacting piston may be optional, instead, simply a bailer that opens to allow the metal particles 304 to spill out and fall into a containment system positioned towards the down-end of the assembly, can be utilized. In that embodiment, the weight of the metal particles (e.g., beads) may be relied on to perform the packing operation over a piston and deployed containment to perform the sweeping operation along the wellbore. %

In embodiments, the metal particles (e.g., in the sealing element 206 of FIGS. 2A and 2B, in the sealing element 302 of FIG. 3A-3C) may include at least one of an alkaline earth metal, a transition metal, and a post-transition metal. For example, the metal particles as a swellable metal can include at least one of magnesium, aluminum, and calcium that can hydrolyze when reacted with water in a fluid to form a metal hydroxide. The metal hydroxide can be substantially insoluble in water. The swellable metal can, in at least one example, be one metal. In other examples, the swellable metal can be an alloy to increase the reactivity or to control the formation of hydroxides/oxides where the alloying element can include at least one of aluminum, zinc, manganese, zirconium, yttrium, neodymium, gadolinium, silver, calcium, tin, rhenium, and any other suitable elements. The alloy swellable metal can be further alloyed with a dopant that promotes corrosion. For example, the dopant can include at least one of nickel, iron, copper, cobalt, carbon, tungsten, tin, gallium, bismuth, or any other suitable dopant that promotes corrosion. Additional ions can also be added to the reaction, for example, silicate, sulfate, aluminate, phosphate, or any other suitable ions. The swellable metal can be constructed in a solid solution process where the elements are combined with molten metal. In other examples, the swellable metal can be constructed with a powder metallurgy process.

The reaction of a swellable metal with a fluid is shown below, where Mis a metal, O is oxygen, H is hydrogen, and a, b and c are numbers which can be the same or different:

$$M+\alpha H_xO \rightarrow M(OH)_b+cH_2$$

For example, if the metal is magnesium, the hydration reaction is:

$$Mg+2H_2O \rightarrow Mg(OH)_2+H_2.$$

$Mg(OH)_2$ takes 85% more volume than the original magnesium.

In other example, if the metal is aluminum, the hydration reaction is:

$$Al+3H_2O \rightarrow Al(OH)_3+3/2H_2$$

$Al(OH)_2$ takes 160% more volume than the original aluminum.

In yet another example, if the metal is calcium, the hydration reaction is:

$$Ca+H_2O \rightarrow Ca(OH)_2$$

$Ca(OH)_2$ takes 32% more volume than the original calcium.

The term "swellable" when used to describe the metal is meant to convey that the volume of the hydrolytically reacted byproducts has a greater volume than the original metal. For example, the swellable metal reacts with water to create micron-sized particles and then the particles lock together to create a seal. In some examples, the volume of the space proximate the swellable metal is less than the expansion volume of the swellable metal such that the swellable metal, when transitioning to the expanded configuration, can abut the surface of the fluid channel to provide a seal. For example, the free volume proximate the swellable metal can be approximately half of the expansion volume. For example, in the case of magnesium as the swellable metal, the free volume proximate the magnesium can be less than 85% of the volume of the original magnesium. The free volume can be expressed as the cross-sectional area of the metal and the cross-sectional area of the space that needs to be sealed.

An embodiment is a method of sealing a borehole, including placing a downhole tool (e.g., packer) at a selected position (e.g., openhole washout) in the borehole, the downhole tool including a sealing element having metal particles disposed about a tool mandrel. The method includes driving a hydrostatic piston of the downhole tool to move a containment component of the downhole tool to move the metal particles in an axial direction, thereby displacing the metal particles in a radial direction toward a borehole wall of the borehole to form a seal between the downhole tool and the borehole wall. Thus, the seal may be formed in an annulus of the borehole between the downhole tool and the borehole wall.

In implementations, the displacing of the metal particles in the radial direction toward the borehole wall increases a cross sectional area of the sealing element in the radial direction toward the borehole wall by at least 90%. The driving of the hydrostatic piston can involve moving the hydrostatic piston in the axial direction with borehole fluid via borehole pressure. In implementations, the moving of the containment component involves moving the containment component axially in a downward direction, thereby moving the metal particles axially to displace the metal particles in the radial direction toward the borehole wall, wherein the containment component is an upper containment component. In these implementations, the method may include restraining by a lower containment component of the downhole tool the moving of the metal particles axially in the downward direction past the lower containment component.

The method may include initially holding the metal particles against the tool mandrel with a retainment sleeve of the sealing element, wherein driving the hydrostatic piston to move the containment component applies force to the retainment sleeve to release the metal particles in the radial direction toward the borehole wall. In implementations, displacing the metal particles includes rearranging the metal particles that decreases length of axial disposition of the metal particles along downhole tool and increases disposition of the metal particles in the radial direction. In implementations, the method can include reacting the metal particles with borehole fluid having water, thereby increasing size of the metal particles to promote forming the seal.

Accordingly, the present disclosure may provide sealing elements that include metal elements such as metal particles. The methods, systems, and tools may include any of the various features disclosed herein, including one or more of the following statements.

Statement 1. A downhole tool for use in a borehole, comprising: a mandrel; a sealing element comprising metal particles disposed about the mandrel; and a piston to move a containment component of the downhole tool in an axial direction to move the metal particles in the axial direction, thereby displacing the metal particles in a radial direction toward a borehole wall to expand the sealing element in the radial direction to form a seal between the downhole tool and the borehole wall.

Statement 2. The downhole tool of Statement 1, wherein the downhole tool is configured to form the seal in an openhole washout of the borehole, or to form the seal in a cased portion of the borehole.

Statement 3. The downhole tool of Statement 1 or 2, wherein expanding the sealing element in the radial direction increases a cross sectional area of the sealing element in the radial direction toward the borehole wall by at least 90%.

Statement 4. The downhole tool of any preceding Statement, wherein the piston comprises a hydrostatic piston to be driven by borehole pressure, and wherein movement of the metal particles in the axial direction compacts the metal particles in the axial direction to displace the metal particles in the radial direction toward the borehole wall.

Statement 5. The downhole tool of any preceding Statement, wherein the containment component is an upper containment component to move axially in a downward direction to move the metal particles axially in the downward direction to displace the metal particles in the radial direction toward the borehole wall, and wherein the downhole tool comprises a lower containment component to restrain axial movement of the metal particles past the lower containment component.

Statement 6. The downhole tool of any one of Statement 1 to 4, wherein the containment component is a lower containment component to move axially in an upward direction to move the metal particles axially in the upward direction to displace the metal particles in the radial direction toward the borehole wall, and wherein the downhole tool comprises an upper containment component to restrain axial movement of the metal particles past the upper containment component.

Statement 7. The downhole tool of any preceding Statement, wherein the sealing element comprises a retainment sleeve to hold the metal particles against the mandrel, and wherein the piston is configured to apply force to the retainment sleeve to release the metal particles in the radial direction toward the borehole wall.

Statement 8. The downhole tool of any preceding Statement, wherein the metal particles comprise at least one of magnesium, aluminum, or calcium.

Statement 9. The downhole tool of any preceding Statement, wherein the metal particles are configured for reaction with borehole fluid comprising water that increases size of the metal particles to promote forming the seal.

Statement 10. The downhole tool of any preceding Statement, wherein the downhole tool is a packer configured to form the seal in an annulus of the borehole between the downhole tool and the borehole wall.

Statement 11. A method of sealing a borehole, comprising: placing a downhole tool at a selected position in the borehole, the downhole tool comprising a sealing element having metal particles disposed about a tool mandrel; and driving a hydrostatic piston of the downhole tool to move a containment component of the downhole tool to move the metal particles in an axial direction, thereby displacing the metal particles in a radial direction toward a borehole wall of the borehole to form a seal between the downhole tool and the borehole wall.

Statement 12. The method of Statement 11, wherein the selected position comprises an openhole washout of the borehole or a cased portion of the borehole.

Statement 13. The method of Statement 11 or 12, wherein displacing the metal particles in the radial direction toward the borehole wall increases a cross sectional area of the sealing element in the radial direction toward the borehole wall by at least 90%.

Statement 14. The method of any one of Statement 11 to 13, wherein driving the hydrostatic piston comprises moving the hydrostatic piston in the axial direction with borehole fluid via borehole pressure.

Statement 15. The method of any one of Statement 11 to 14, wherein moving the containment component comprises moving the containment component axially in a downward direction, thereby moving the metal particles axially to displace the metal particles in the radial direction toward the borehole wall, wherein the containment component is an upper containment component.

Statement 16. The method of any one of Statement 11 to 15, comprising restraining by a lower containment component of the downhole tool the moving of the metal particles axially in the downward direction past the lower containment component.

Statement 17. The method of any one of Statement 11 to 16, comprising initially holding the metal particles against the tool mandrel with a retainment sleeve of the sealing element, wherein driving the hydrostatic piston to move the containment component applies force to the retainment sleeve to release the metal particles in the radial direction toward the borehole wall.

Statement 18. The method of any one of Statement 11 to 17, wherein displacing the metal particles comprises rearranging the metal particles that decreases length of axial disposition of the metal particles along downhole tool and increases disposition of the metal particles in the radial direction.

Statement 19. The method of any one of Statement 11 to 18, comprising reacting the metal particles with borehole fluid comprising water, thereby increasing size of the metal particles to promote forming the seal.

Statement 20. The method of any one of Statement 11 to 19, wherein the downhole tool is a packer, and wherein the seal is formed in an annulus of the borehole between the downhole tool and the borehole wall.

What is claimed is:

1. A downhole tool for use in a borehole, comprising:

a mandrel;

a sealing element comprising metal particles disposed about the mandrel; and a piston to move a containment component of the downhole tool in an axial direction to move the metal particles in the axial direction, thereby displacing the metal particles in a radial direction toward a borehole wall to expand the sealing element in the radial direction to form a seal between the downhole tool and the borehole wall, wherein the containment component as deployed is configured to contact the borehole wall and axially contain the metal particles.

2. The downhole tool of claim 1, wherein the downhole tool is configured to form the seal in an openhole washout of the borehole or to form the seal in a cased portion of the borehole, and wherein the containment component comprises a petal plate, a rubber cup, an inflatable element, an expansion foam, or an expansion rubber, or any combinations thereof.

3. The downhole tool of claim 1, wherein expanding the sealing element in the radial direction by displacing the metal particles in the radial direction increases a cross sectional area of the sealing element in the radial direction toward the borehole wall by at least 90%, and wherein the containment component is configured to deploy from an undeployed state to axially contain the metal particles.

4. The downhole tool of claim 1, wherein the piston comprises a hydrostatic piston to be driven by borehole pressure, wherein the containment component is disposed between the piston and the metal particles, wherein the containment component comprises a plate, and wherein movement of the metal particles in the axial direction compacts the metal particles in the axial direction to displace the metal particles in the radial direction toward the borehole wall.

5. The downhole tool of claim 1, wherein the containment component is an upper containment component to move axially in a downward direction to move the metal particles axially in the downward direction to displace the metal particles in the radial direction toward the borehole wall, and wherein the downhole tool comprises a second containment component that is a lower containment component to restrain axial movement of the metal particles past the lower containment component.

6. The downhole tool of claim 1, wherein a starting length of the sealing element along the mandrel is at least 150% of a final length of the sealing element formed as a seal between the downhole tool and the borehole wall, and wherein the containment component as deployed is configured to interface with the metal particles.

7. The downhole tool of claim 1, wherein the sealing element comprises a retainment sleeve to hold the metal particles against the mandrel, wherein the containment component is configured to be mechanically deployed by action of the piston, and wherein the piston is configured to apply force to the retainment sleeve to release the metal particles in the radial direction toward the borehole wall.

8. The downhole tool of claim 1, wherein the sealing element comprises a retainment sleeve to hold the metal particles against the mandrel, wherein the containment component is configured to apply force to the retainment sleeve to release the metal particles in the radial direction toward the borehole wall, and wherein the metal particles comprise at least one of magnesium, aluminum, or calcium.

9. The downhole tool of claim 1, wherein the metal particles are configured for reaction with borehole fluid comprising water that increases size of the metal particles to promote forming the seal, wherein more of the seal is formed by mechanical rearrangement of the metal particles than the reaction, and wherein the containment component as deployed contacts the borehole wall.

10. The downhole tool of claim 1, wherein the downhole tool is a packer configured to form the seal in an annulus of the borehole between the downhole tool and the borehole wall, wherein the containment component is configured to deploy from an undeployed state to provide axial containment of the metal particles, and wherein the containment component comprises petal plates with mesh.

11. A method of sealing a borehole, comprising:

placing a downhole tool at a selected position in the borehole, the downhole tool comprising a sealing element having metal particles disposed about a tool mandrel;

driving a hydrostatic piston of the downhole tool to move a containment component of the downhole tool to move the metal particles in an axial direction, thereby displacing the metal particles in a radial direction toward a borehole wall of the borehole to form a seal between the downhole tool and the borehole wall; and deploying the containment component from an undeployed state, thereby retaining the metal particles, wherein the containment component as deployed contacts the borehole wall.

12. The method of claim 11, wherein the selected position comprises an openhole washout of the borehole or a cased portion of the borehole, wherein retaining comprises axially containing the metal particles with the containment component, and wherein the containment component comprises a petal plate, a rubber cup, an inflatable element, an expansion foam, or an expansion rubber, or any combinations thereof.

13. The method of claim 11, wherein displacing the metal particles in the radial direction toward the borehole wall increases a cross sectional area of the sealing element in the radial direction toward the borehole wall by at least 90%, and wherein retaining comprises providing axial containment of the metal particles with the containment component.

14. The method of claim 11, wherein driving the hydrostatic piston comprises moving the hydrostatic piston in the axial direction with borehole fluid via borehole pressure.

15. The method of claim 11, wherein moving the containment component comprises moving the containment component axially in a downward direction, thereby moving the metal particles axially to displace the metal particles in the radial direction toward the borehole wall, wherein the containment component is an upper containment component.

16. The method of claim 15, comprising restraining by a second containment component that is a lower containment component of the downhole tool the moving of the metal particles axially in the downward direction past the lower containment component.

17. The method of claim 11, comprising initially holding the metal particles against the tool mandrel with a retainment sleeve of the sealing element, wherein driving the hydrostatic piston to move the containment component applies force to the retainment sleeve to release the metal particles in the radial direction toward the borehole wall, and wherein the containment component comprises a plate.

18. The method of claim 11, wherein displacing the metal particles comprises rearranging the metal particles that decreases length of axial disposition of the metal particles along the downhole tool and increases disposition of the metal particles in the radial direction, and wherein a starting length of the axial disposition is at least 150% of a final length of the axial disposition with the metal particles formed as the seal.

19. The method of claim 18, comprising reacting the metal particles with borehole fluid comprising water, thereby increasing size of the metal particles to promote forming the seal, and wherein more of the seal is formed by rearranging the metal particles than the reacting of the metal particles with the borehole fluid.

20. The method of claim 11, wherein the containment component is disposed between the piston and the metal particles, wherein the downhole tool is a packer, and wherein the seal is formed in an annulus of the borehole between the downhole tool and the borehole wall.

* * * * *